US006210184B1

(12) United States Patent
Kodama et al.

(10) Patent No.: US 6,210,184 B1
(45) Date of Patent: Apr. 3, 2001

(54) CONNECTOR STRUCTURE WHICH ENABLES THE FITTING OF CONNECTORS ASSOCIATED WITH AN INSTRUMENT PANEL WITH A MINIMUM FORCE

(75) Inventors: Shinji Kodama; Kei Sato, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/272,327

(22) Filed: Mar. 19, 1999

(30) Foreign Application Priority Data

Mar. 20, 1998 (JP) ..... 10-072660

(51) Int. Cl.[7] ..... H01R 13/62
(52) U.S. Cl. ..... 439/157
(58) Field of Search ..... 439/157, 152, 439/153, 339, 347

(56) References Cited

U.S. PATENT DOCUMENTS 3,209,302 * 9/1965 Uberbacher ..... 439/153
4,990,096 * 2/1991 Bujtas et al. ..... 439/157
5,618,194 * 4/1997 Maue et al. ..... 439/157
5,997,322 * 12/1999 Kashiyama et al. ..... 439/157

FOREIGN PATENT DOCUMENTS 6-325822 * 11/1994 (JP) .

OTHER PUBLICATIONS

TDB NN9211148 Nov. 1, 1991 IBM Corporation.*

* cited by examiner

*Primary Examiner*—Neil Abrams
*Assistant Examiner*—Michael C. Zarroli
(74) *Attorney, Agent, or Firm*—Sughrue, Mion, Zinn, Macpeak & Seas, PLLC

(57) ABSTRACT

A connector structure enabling fitting and releasing of a connector (25) of a first frame (20) and another connector (41) of a second frame (40). The second frame (40) includes a sliding cam (43), and the first frame (20) includes a first cam follower (24) moving within the sliding cam (43) of the second frame. Further, the second frame (40) includes a reversely sliding cam (44). A second cam follower (46) moving within the reversely sliding cam (44) is provided in a slider (45). The slider (45) is slidable relative to the frame (40) by a screw member (47). When the screw member (47) is tightened, the frame (40) is movable in a transverse direction (B), substantially perpendicular to a connector fitting direction (A), via the second cam follower (46) and the reversely sliding cam (44) and is movable in the connector fitting direction (A) via the first cam follower (24) and the sliding cam (43).

2 Claims, 5 Drawing Sheets

CONNECTOR STRUCTURE WHICH ENABLES THE FITTING OF CONNECTORS ASSOCIATED WITH AN INSTRUMENT PANEL WITH A MINIMUM FORCE

BACKGROUND OF THE INVENTION

1. Field of the Invention

The present invention relates to a multipolar and miniature connector structure which enables the fitting and release of, for example, connectors of an instrument panel side (a wire harness side) and connectors of a meter side (a dashboard side) of a vehicle with a small operating force.

The present application is based on Japanese Patent Application No. Hei. 10-72660, which is incorporated herein by reference.

2. Description of the Related Art as an example, Unexamined Japanese Patent Publication No. Hei. 6-325822 discloses a connector of the above-described type shown in FIGS. 4A to 7. The connector 1 includes levers 3 pivotably supported by an axis 2*a* extending toward opposite sides of the connector 1, a male connector housing 2 and a female connector housing 6. The male connector housing 2 is attached movably in a front-to-rear direction relative to the inside panel 5*a* of an instrument panel 5 of a vehicle via a bracket 4. The female connector housing 6 has projections 6*a*, 6*b* on its sides. The projections 6*a*, 6*b* can respectively slide on a pair of arm portions 3*a*, 3*a* of levers 3 while holding the arm portions 3*a*, 3*a* therebetween. The male connector housing 2 is fitted to and released from a hood portion 6*c* by the female connector housing 6.

Under the female connector housing 6, there is provided a rail portion 9 for supporting movably back and forth a slider 8 pivoted by a screw member 7 at its distal end. The slider 8 is adapted to receive a rod-like slider attaching portions 3*b* of the lever 3 in a recess 8*a* thereof. As shown in FIGS. 5 and 6, when the lever 3 is turned in a front-to-rear direction of both male and female connector housings 2 and 6 by rotation of the screw member 7, the fitting and releasing operations of both housings 2 and 6 are performed, via the projections 6*a*, 6*b*, with a small force by action of leverage (an assistor).

As shown in FIG. 7, a meter (a dash board) M is attached through bolts and nuts (not shown) under the inside panel 5*a* of the instrument panel 5.

In the above-described connector 1, however, since the levers 3 are actuated by rotating the screw member 7 with a tool such as a screw driver or the like, an area is needed for operating the levers 3, so that the connector structure is relatively large. Further, since the screw members are independent for fitting both male and female connector housings 2 and 6 and securing the meter M to the underside of the inside panel 5*a* of the instrument panel 5, the attachment operation is troublesome.

SUMMARY OF THE INVENTION

Thus, the present invention has been made to solve the above mentioned problems, and it is an object of the present invention to provide a connector structure, in which the entire structure is miniaturized, the fitting and releasing of both male and female connectors may be performed with a single screw member, and electric equipment may be easily attached to the side of a body which is to be attached.

To achieve the above object, according to the first aspect of the present invention, there is provided a connector structure which enables to fit together and release from each other one of male and female connectors provided on one frame side and the other one of the male and female connectors provided on the other frame side. More specifically, the connector structure preferably comprises a first frame including a first connector and a first cam follower, a second frame including a second connector fittable to the first connector, a slanting cam along which the first cam follower is moved, and a reversely slanting cam slanting in non-parallel with the slanting cam, a screw member having a body penetrating the second frame, and a slider attached onto the body of the screw member, the slider being slidable on the body of the screw member by screwing the screw member, and the slider having a second cam follower which is moved along the reversely slanting cam when the screw member is rotated, wherein, when the screw member is screwed, the second frame is moved in a direction substantially perpendicular to a connector fitting direction of the first and second connectors in accordance with movement of the second cam follower along the reversely slanting cam, and is moved in the connector fitting direction in accordance with movement of the first cam follower along the slanting cam.

According to the above-described connector structure, both the male and female connectors may be fitted and released with a small operating force. Furthermore, the second frame is provided with the slanting cam, while the first frame is provided with the cam follower moving along the slanting cam, and since these members are not largely protruded outward, the entire body of the connector structure may be simplified and miniaturized in comparison with the related connector structure employing the lever mechanism.

Furthermore, according to the second aspect of the present invention, preferably, the first frame is attached to an attachment body having an engagement portion and a tightening portion, the first frame has an elastic retaining portion which is engaged with the engagement portion when the first frame is attached to an attachment body, and the screw member is penetrated through an attaching portion to which an electric equipment is connected, and is engaged with the tightening portion, and wherein the second frame is moved by screwing the screw member to the tightening portion.

According to the second aspect of the present invention, the electric equipment can be easily secured to the attachment body by the screw member, and therefore the number of the component parts is saved thereby, and the cost reduced.

DETAILED DESCRIPTION OF THE PREFERRED EMBODIMENT

One preferred embodiment of the present invention will now be described with reference to FIGS. 1 to 3.

Figure 1:
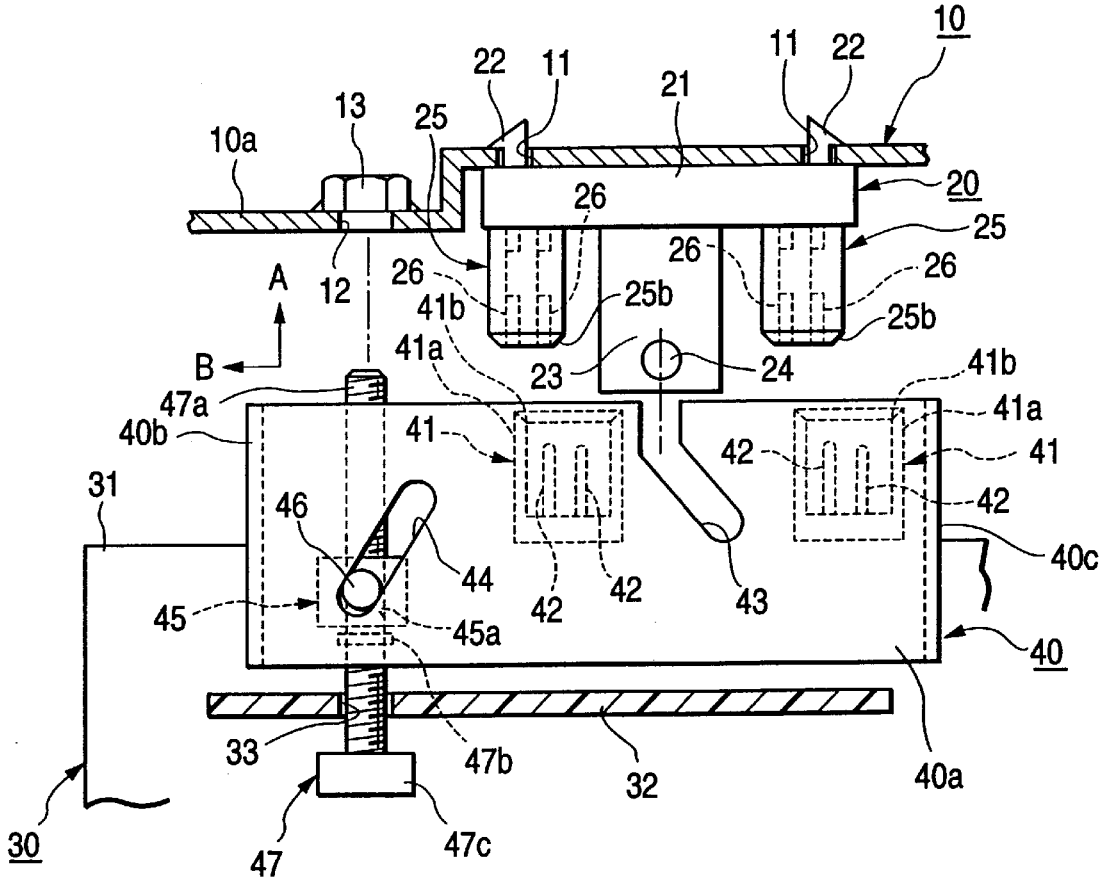
FIG. 1 is a plan view showing a state before fitting both male and female connectors of the connector structure of one embodiment according to the present invention, partially in cross section.
Figure 2:
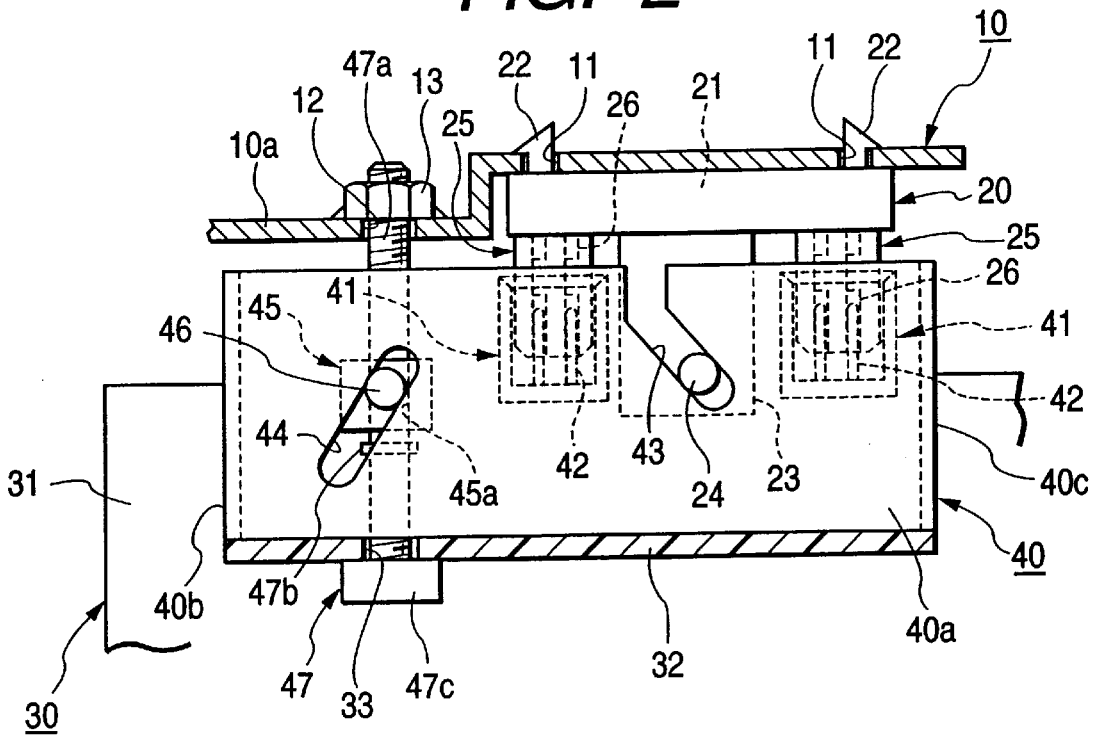
FIG. 2 is a plan view showing a state just before accomplishing the fitting of both male and female connectors of the above mentioned connector structure, partially in cross section.
Figure 3:
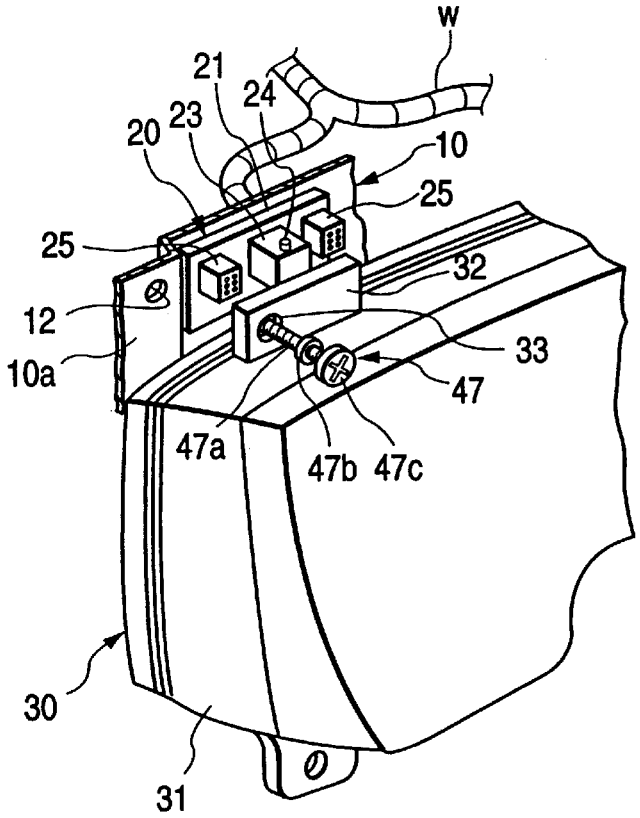
FIG. 3 is perspective views of a portion of an instrument panel and a meter of a vehicle to be applied with the above mentioned connector structure.
Figure 4A:
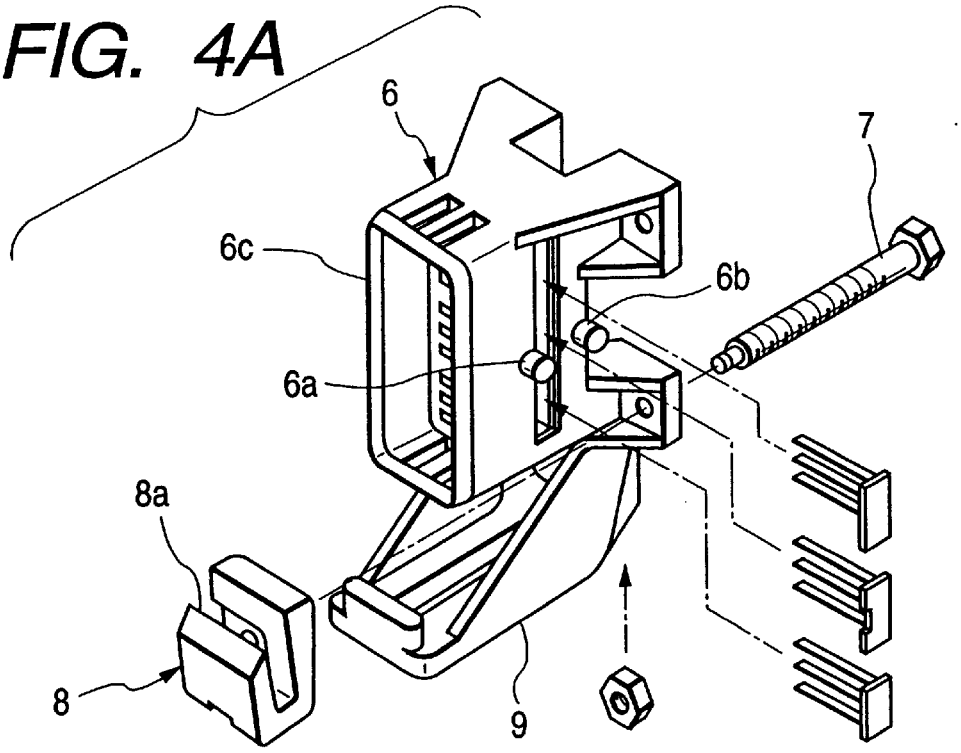
FIG. 4A is a perspective view showing a female connector housing side of the related connector.
Figure 4B:
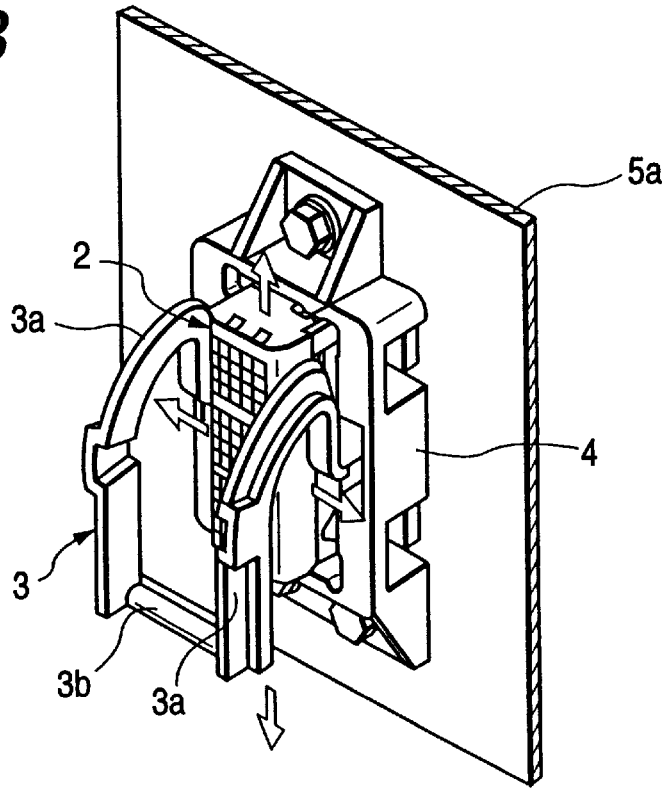
FIG. 4B is a perspective view showing a male connector housing of the related connector.
Figure 5:
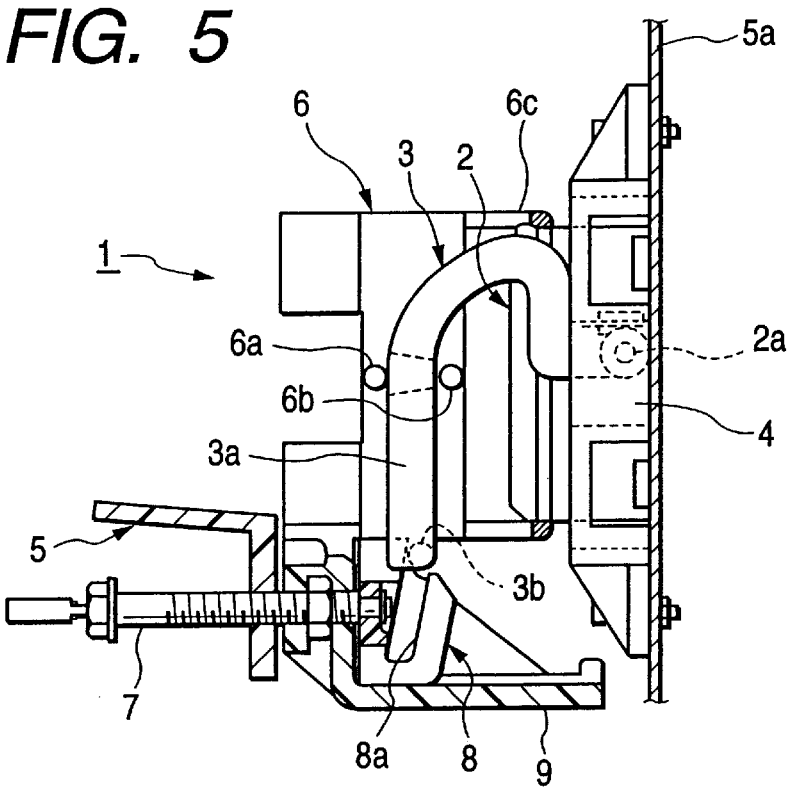
FIG. 5 is a side view showing a temporary fitting of both male and female connector housings of the related connector, partially in cross section.
Figure 6:
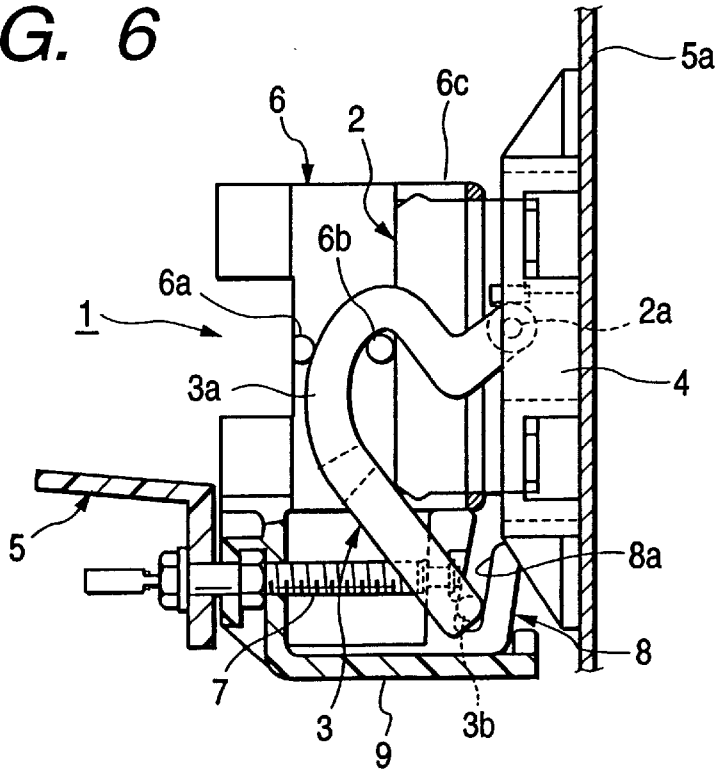
FIG.6 is a side view showing the accomplished fitting of both male and female connector housings of the related connector, partially in cross section.
Figure 7:
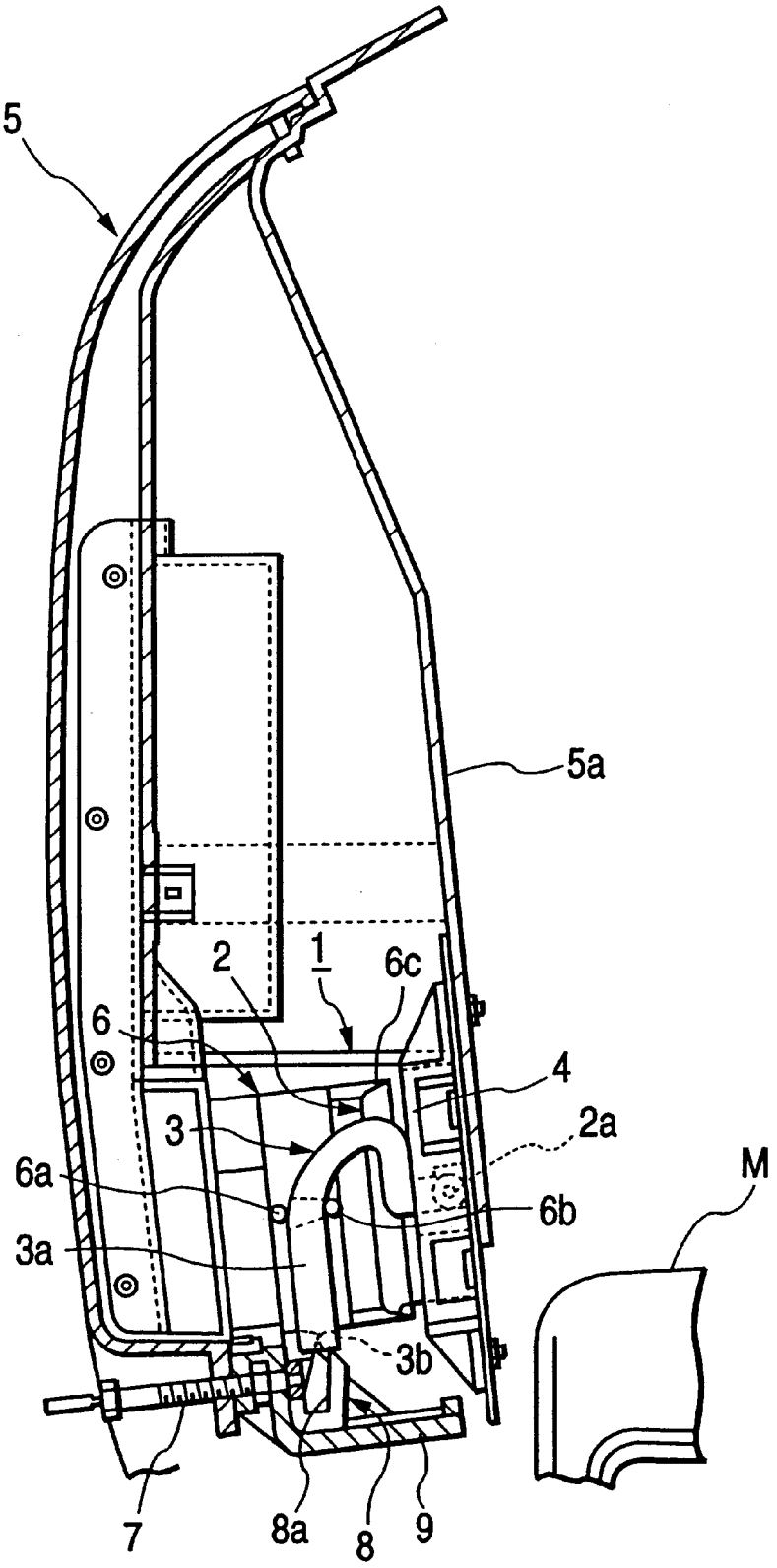
FIG.7 is a side view showing the state of attaching the male and female connector housings to the interior of the instrument panel of a vehicle, partially in cross section.

As shown in FIGS. 1 to 3, the metal instrument panel (an attachment body) 10 for a vehicle has a pair of engagement holes (engagement portions) 11, 11. A step portion 10*a* is protruded toward the passenger compartment side of the vehicle, and is formed adjacent to one of the engagement holes 11, 11 of the instrument panel 10. The step portion 10*a* has a round hole 12 for passing a screw. A nut 13 is fixed to a back side of the round hole 12 by welding or the like.

A connector frame (a first frame) 20 made of a synthetic resin is secured to the engagement holes 11, 11 of the instrument panel 10. More specifically, a pair of elastic engaging pawls (engaging portions) 22, 22 having a hook-like shape are integrally formed on a back side of a plate shaped frame main body 21 of the connector frame 20 at the positions opposite to the engagement holes 11, 11 of the instrument panel 10. The engaging pawls 22, 22 are respectively engaged with the engagement holes 11, 11.

A rectangular convex portion 23 is located at the central part of the frame main body 21, and integrally formed with the frame main body 21. Furthermore, a pair of male connectors (first connectors) having a rectangular shape, are also integrally formed with the frame main body 21 at the both sides thereof. Column shaped projection (first cam followers) 24 for fitting and releasing both connectors are integrally formed with the convex portion 23, and are respectively disposed on front and rear faces of the convex portion 23. A plurality of female terminals (first terminals) 26 are inserted into and accommodated in the male connectors 25. Each of the female terminals 26 is connected with an electric wire (not shown). The electric wires connected to the female terminals 26 are bundled to form a wire harness W (see FIG. 3).

As shown in FIGS. 1 to 3, a box shaped connector frame (a second frame) 40 made of synthetic resin is located between the instrument panel 10 and a bracket (an attaching portion) 32 of a meter case 31 of a meter (a measuring gauge) 30 as an electric equipment. The meter case 31 of the meter 30 has a substantially box-like shape, and is made of the synthetic resin. Further, the meter case 31 is integrally provided with the plate shaped bracket 32 at both sides of the upper surface thereof. The bracket 32 has a round hole 33 for passing a screw therethrough.

As shown in FIGS. 1 and 2, the connector frame 40 has a four-cornered cylindrical shape opening in front and rear sides thereof, and includes upper and lower walls 40*a*, 40*a* and left and right side walls 40*b*, 40*c*. A pair of female connectors (second connectors) 41, 41 are respectively located adjacent to a right side wall 40*c* and a substantially center portion between the upper and lower walls 40*a*, 40*a* of the connector frame 40. A plurality of male terminals (second terminals) 42 are accommodated in box shaped portions 41*a* of the female connectors 41. The male terminals 42 are respectively electrically connected to the female terminals 26 of the male connectors 25 when the female connector 41 and male connector 25 are fitted together.

Slanting grooves (slanting cams) 43 are formed in the upper and lower walls 40*a*, 40*a* of the connector frame 40, and directed toward the right side wall 40*c*. The slanting grooves (slanting cams) 43 each has an inequality sign-like shape, and the front ends thereof are in the vertical direction opened. Each of the column shaped projections 24 projecting from the vertical face of the convex portion 23 of the connector frame 20 slides along and within each of the slanting grooves 43. Further, reversely slanting grooves (reversely slanting cams) 44 are respectively formed in the upper and lower walls 40*a*, 40*a* of the connector frame 40, and directed toward the left side wall 40*b*. The reversely slanting grooves 44 are respectively slanted in a non-parallel relationship with the slanting cams 43 as shown in FIGS. 1 and 2.

Sliders 45 in a nut-like shape made of metal or synthetic resin, are slidably supported between insides of the upper and lower walls 40*a*, 40*a* of the connector frame 40. In the centers of the vertical face of the sliders 45, column-like projections (second cam followers) 46 are respectively projected integrally. Each of the projections 46 slides along and within each of the reversely slanting grooves 44 of the upper and lower walls 40*a*, 40*a* of the connector frame 40. The sliders 45 have screw holes 45*a* into which screw members 47, comprising bolts or the like are attachable by screwing.

The screw members 47 have screw portions 47*a* in which disc shaped brim portions 47*b* are integrally formed for restraining the sliding position of the sliders 45. The screw portion 47*a* is inserted in and passed through a screw passing round hole 33 of the bracket 32 of the meter 30, and is screwed with the nut 13 of the instrument panel 10. When tightening the screw member 47, the connector frame 40 is moved in a crossing direction B substantially perpendicular to the connector fitting direction A via the projection 46 of the slider 45. The connector from 40 the reversely slanting groove 44, and is then moved in the connector fitting direction A via the projection 24 of the convex portion 23 of the connector frame 20 and the slanting groove 43. The connector frame 40 is held between the head portion 47*c* of the screw member 47 and the nut 13.

Since the brackets 32 are integrally projected from the both sides of the upper surface of the meter case 31, the connector frames 20 are secured respectively at the both sides of the instrument panel 10. In addition, taper faces 41*b* and 25*b* are respectively formed on the overall circumference of the front end of the interior of the portion 41*a* of the female connector 41 and the overall circumference of the front end of the exterior of the male connector 25.

In accordance with the above-described connector structure, as shown in FIG. 1, the screw portion 47*a* of the screw member 47 is passed through the round hole 33 of the bracket 32 of the meter 30, and is screwed in the screw hole 45*a* of the slider 45 supported slidably between the upper and lower walls 40*a* and 40*a* of the connector frame 40, so that the screw portion 47*a* of the screw member 47 is projected at its front end out of the connector frame 40 when the screw portion 47*a* of the screw member 47 is inserted into the round hole 12 of the instrument panel 10 from the state where the projection 24 of the convex portion 23 of the connector frame 20 is inserted in the vertical opening of the slanting groove 44 of the connector frame 40, and tightened into the nut 13, the connector frame 40 moves in the crossing direction B (perpendicular to the connector fitting direction A) by virtue of the projection 46 of the slider 45 sliding in the reversely slanting groove 44 of the connector frame 40.

By the movement of the connector frame 40 in the crossing direction B with the connector fitting the connector frame 40 further moves toward the connector fitting direction A via the projection 24 of the convex portion 23 of the connector frame 20 and the sliding groove 43 of the connector frame 40. Thus, as shown in FIG. 2, the male connector 25 of the connector frame 20 and the portion 41*a* of the female connector 41 of the connector frame 40 are fitted, so that the female terminal 26 of the male connector 25 and the male terminal 42 of the female connector 41 are contacted and electrically connected. At the same time, the meter 30 is easily fixed to the side of the instrument panel 10 by the screw member 47 via the bracket 32 of the meter 30. Further, due to leverage of the projection 24 of the convex portion 23 of the connector frame 20 and the sliding groove 43 of the connector frame 40, until the male connector 25 is completely inserted in the food portion 41*a* of the female connector 41, it is fitted with a very small insertion force. Similarly, when the screw member 47 is loosened, the connector frame 40 moves in the connector releasing direction, so that both male and female connectors 25, 41 are released with the small force.

Since, when rotating the screw member 47, the connector frame, 40 having the sliding cam 43, is movable in the fitting and releasing direction of the male and female connectors 25 and 41 due to the sliding cam 43 and the cam follower 24 of the connector frame 20, it is possible to easily fit or release the male and female connectors 25 and 41 with small force. The projection 24 of the connector frame 20 and the sliding groove 43 and the reversely sliding groove 44 of the connector frame 40 are arranged such that the entire body of the connector structure may be simplified and miniaturized in comparison with the related connector structure employing the lever mechanism. Since the meter 30 can be easily fixed to the side of the instrument panel 10 by means of one screw member 47 for fitting both male and female connectors 25 and 41, the number of the members can be reduced, resulting in a cost saving.

In the above-mentioned embodiment, the instrument panel has been referred to as the attachment body to be attached to the connectors and the meter has been referred to as the electric equipment, but of course any combinations of other panels and equipment, etc. may be alternatively used. In addition, the projections (as the first cam followers) were provided in the side of the male connectors, while the sliding grooves (as the sliding cams) were provided in the side of the frame having the female connectors. However, the structure may be also modified to provide the sliding grooves (as the sliding cams) in the side of the male connectors, and to provide the projections (as the first cam followers) in the side of the frame. Furthermore, the shapes of the sliding cams and the reversely sliding cams are not limited to the hole shaped sliding grooves.

As described above, according to the present invention, since, by rotating the screw member, the frame provided with the slanting cam is made movable in the direction of fitting and releasing both male and female connectors via the slanting cam and the cam follower, both connectors may be fitted and released with a small operating force. Further any either one of the frame and the other frame is provided with the slanting cam, while the other frame is provided with the cam follower moving along the slanting cam, and since these members are not largely protruded outward, the whole body of the connector structure may be simplified and miniaturized in comparison with the related connector structure employing the lever mechanism.

According to the present invention, the electric equipment can be easily secured to the side of the body to be attached by one screw member for fitting both male and female connectors, and the number of the component parts is saved thereby, so that the whole body of the structure may be decreased in cost.

What is claimed is:

1. A connector structure comprising:

a first frame including a first connector and a first cam follower;

a second frame including a second connector fittable to the first connector, a slanting cam along which the first cam follower is moved, and a reversely slanting cam;

a screw member having a body penetrating the second frame; and a slider attached onto the body of the screw member, the slider being slidable on the body of the screw member by rotating the screw member, and the slider having a second cam follower which is moved along the reversely slanting cam when the screw member is rotated, wherein, when the screw member is rotated, the second frame is moved in a direction substantially perpendicular to a connector fitting direction of the first and second connectors in accordance with movement of the second cam follower along the reversely slanting cam, and the second frame is moved in substantially the connector fitting direction in accordance with movement of the first cam follower along the slanting cam.

2. The connector structure of claim 1, wherein the first frame 20 is attached to an attachment body 10 having an engagement portion 11 and a tightening portion 13, the first frame has an elastic retaining portion 22 which is engaged with the engagement portion 11 when the first frame is attached to the attachment body 10, the screw member is penetrated through attaching portion 12 to which electric equipment is connected, and is engaged with the tightening portion, and wherein the second frame is moved by rotating the screw member to the tightening portion.

* * * * *